United States Patent [19]

Milberger et al.

[11] Patent Number: 4,682,126

[45] Date of Patent: Jul. 21, 1987

[54] ELECTROMAGNET FOR PROGRAMMABLE MICROWAVE CIRCULATOR

[75] Inventors: Walter E. Milberger, Severna Park; Joel R. Cohen, Silver Spring; Leonard Dubrowsky, Owings Mills, all of Md.

[73] Assignee: The United States of America as represented by the Secretary of the Air Force, Washington, D.C.

[21] Appl. No.: 616,347

[22] Filed: Jun. 1, 1984

[51] Int. Cl.[4] ..... H01P 1/18; H01P 1/22; H01F 27/34

[52] U.S. Cl. ..... 333/81 B; 333/1.1; 333/24.1; 333/158; 336/219

[58] Field of Search ..... 333/24.1, 158, 1.1, 333/239; 335/243, 296, 297, 299, 84, 91, 219; 336/178, 219, 212, 216; 428/692, 900; 29/602 R, 609

[56] References Cited

U.S. PATENT DOCUMENTS

| | | | |
|---|---|---|---|
| 2,725,502 | 11/1955 | Chiles, Jr. et al. | 336/219 X |
| 2,887,454 | 5/1959 | Toulmin, Jr. | 335/297 X |
| 3,101,458 | 8/1963 | Chandler et al. | 333/24.2 X |
| 3,401,361 | 9/1968 | Schloemann | 333/31 |
| 3,594,812 | 7/1971 | Buck | 343/854 |
| 3,670,278 | 6/1972 | Foster et al. | 336/219 X |
| 3,719,911 | 3/1973 | Tomita | 336/219 X |
| 3,761,845 | 9/1973 | Ajioka et al. | 333/24.1 |
| 3,819,427 | 6/1974 | Baesch | 335/296 X |
| 4,025,379 | 5/1977 | Whetstone | 428/692 X |
| 4,265,682 | 5/1981 | Tsuya et al. | 335/297 X |
| 4,427,462 | 1/1984 | Senro et al. | 29/609 X |

*Primary Examiner*—T. H. Tubbesing
*Assistant Examiner*—Gilberto Barrón, Jr.
*Attorney, Agent, or Firm*—Bernard E. Franz; Donald J. Singer

[57] ABSTRACT

A "Spacercore" design is used to provide the cores of the electromagnets which are used to bias ferrite slabs in phase shifters of a high power RF attenuator. The phase shifters require a given flux to provide a phase shift from zero to 90°. With laminations of high permeability silicon steel, the core weight may be substantially reduced by including a filler comprising spacers of non-magnetic material (such as lightweight transformer pressboard. With 14-mil silicon steel laminations and 64-mil spacers, this construction provides a core which weighs 25 percent of a full ferrite core for the same flux density.

4 Claims, 13 Drawing Figures

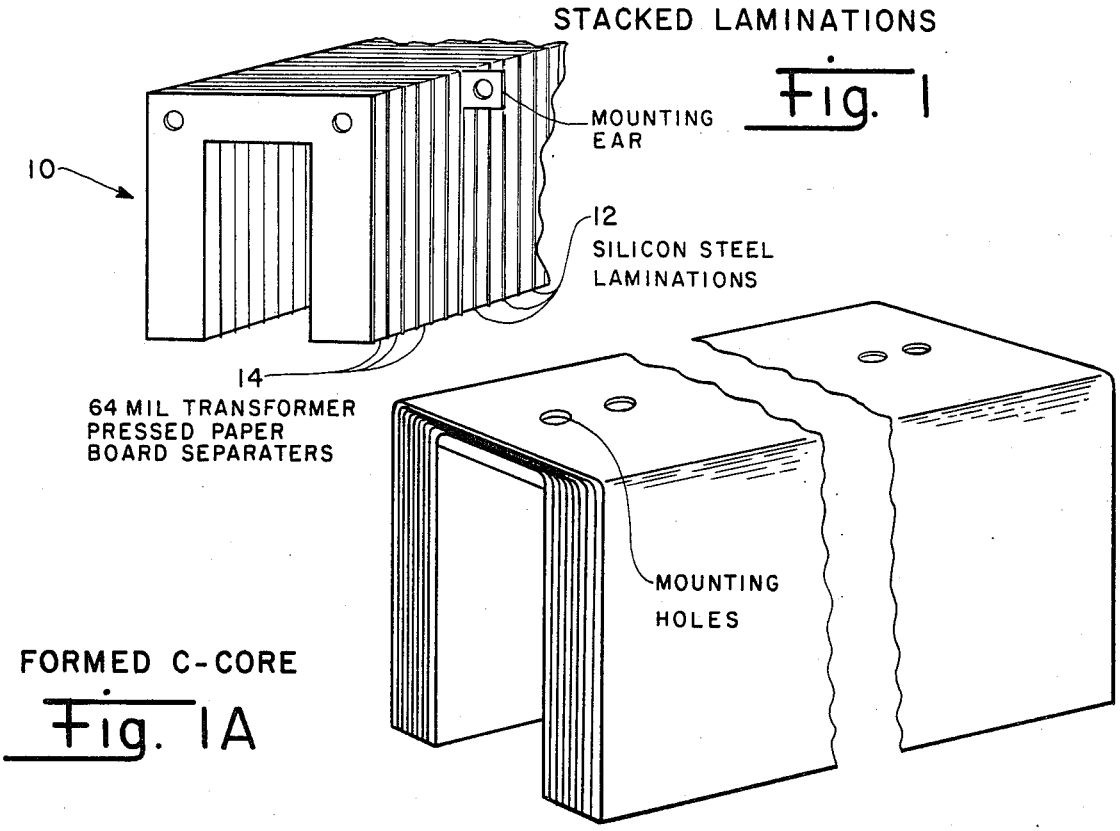
Fig. 1
Fig. 1A
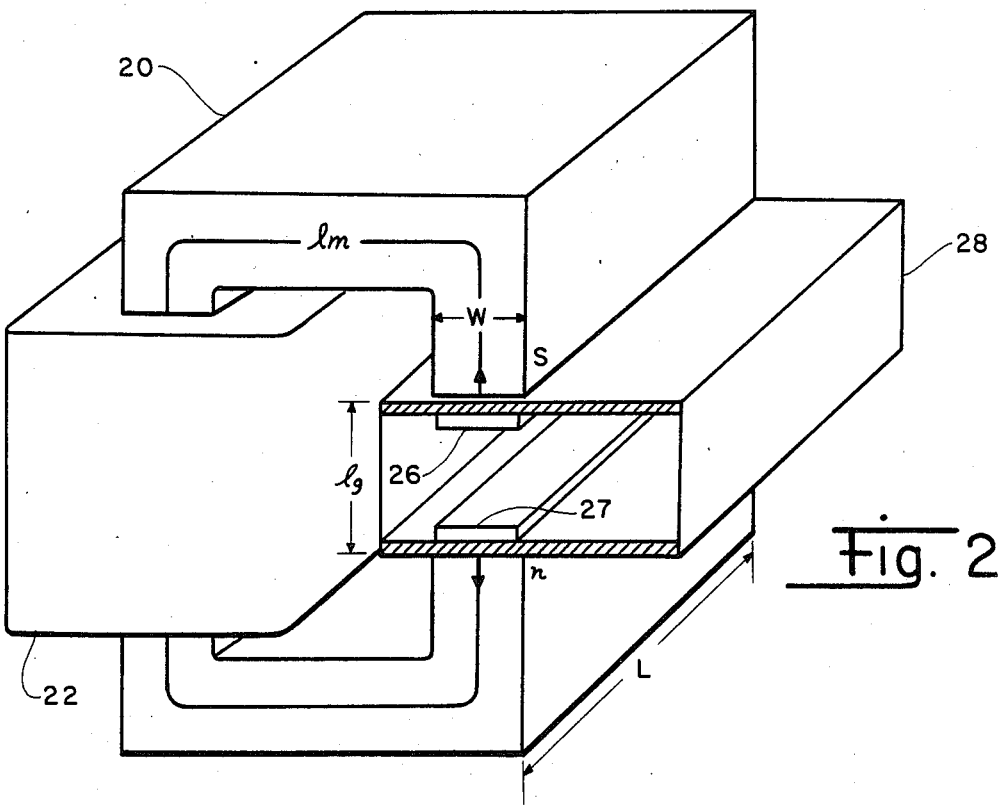
Fig. 2

DIFFERENTIAL PHASE SHIFT VERSUS CURRENT

DIFFERENTIAL PHASE SHIFT VERSUS DRIVE CURRENT
(90 TURN SPACER CORE MAGNET COIL)

ELECTROMAGNET FOR PROGRAMMABLE MICROWAVE CIRCULATOR

RIGHTS OF THE GOVERNMENT

The invention described herein may be manufactured and used by or for the Government of the United States for all governmental purposes without the payment of any royalty.

BACKGROUND OF THE INVENTION

This invention relates to electromagnets for a high power attenuator using a programmable microwave circulator. and more particularly to a core design for the electromagnets used in phase shifters having ferrite slabs in waveguides.

Phase shifters and other microwave devices having ferrite slabs in a waveguide, with biasing or control magnets are well known. For example, U.S. Pat. No. 3,101,458 to Chandler et al to discloses ferrite elements mounted on opposing walls of the waveguide. U.S. Pat. No. 3,401,361 to Schloemann discloses a reciprocal phase shifter having discrete ferrite bodies providing a symmetrical distribution of magnetization states about the center plane of a waveguide transmission structure. Also of general interest are U.S. Pat. Nos. 3,761,845 to Ajoika et al and 3,594,812 to Buck which disclose ferrite phase shifters.

The advantages of electronic programmable high power microwave differential phase shift circulators are many. Such control permits rapid high-power switching, power splitting, or continuously or stepped variable attenuation with minimal phase modulation. The disadvantage of most electromagnetic circulators is that they weigh much more than a comparable permanent magnet type for the same power rating. The weight of programmable circulators restricts their use in aerospace and spacecraft applications where weight is an important consideration.

In some advanced high-power transmitter applications, it is necessary to control output peak power as a function of a particular system parameter. As a result of the unavailability of low loss, high power, microwave analog attenuators with low phase distortion, it has been proposed to design an attenuator with the amplitude control function in the low level portion of the transmitter amplifier chain. While the ability to control output power at low levels would at first appear to be an advantage, this approach imposes severe constraints on the properties and tolerances of subsequent RF devices in the transmitter chain, resulting in a negative impact on the yield of expensive components. The availability of a high peak and average power attenuator with low loss, low phase distortion, and fast switching would allow all the elements of the transmitter chain to operate close to their optimum efficiency and maximum stabitlity points.

SUMMARY OF THE INVENTION

An object of the invention is to provide a lightweight programmable microwave circulator whose weight, including electronic drivers and power supplies, is comparable to the permanent magnet counterpart.

The circulator according to the invention includes an eletromagnet having a core comprising thin laminations of magnetic material (such as silicon steel) interleaved with relatively thick lightweight non-magnetic separator material. This "Spacercore" design substantially reduces the weight of the core assembly of an electromagnet used under conditions of a large air gap between poles.

The Spacecore construction technique is superior to applications using a ferrite core for high temperature operation and, in general, would weight 25 percent of a ferrite core for the same flux density.

BRIEF DESCRIPTION OF THE DRAWING

FIGS. 1 and 1A are isometric views of different embodiments of the Spacercore construction according to the invention;

FIGS. 2 and 3 are isometric views of the phase shifter section, with two-slab and four-slab ferrite loads respectively;

DETAILED DESCRIPTION

FIG. 1 shows the Spacercore construction of a laminated silicon steel core 10, which comprises 14-mil (0.014 inch) silicon steel laminations 12, with 64-mil transformer pressed paper board separators 14. This core is one of four used in the four-slab phase shifters used in the high-power attenuator. FIG. 1A shows a Spacercore structure having a formed C-core, which facilitates mechanical mounting.

Figure 3:
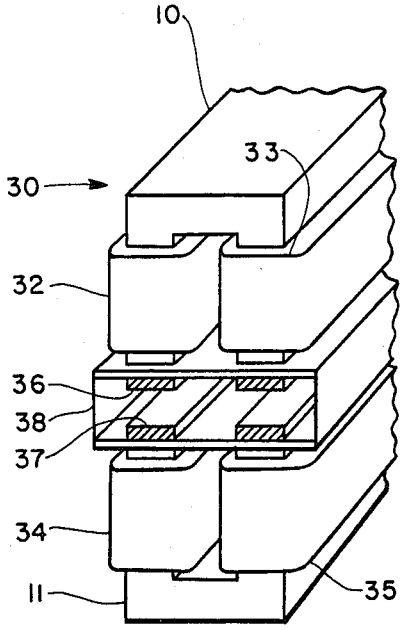
Figure 4:
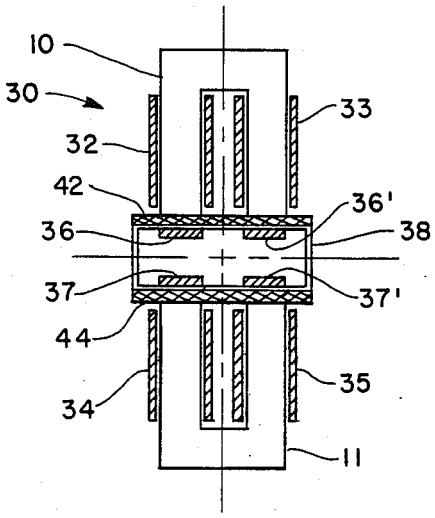
FIG. 4 is a cross-section view of the phase shifter section of FIG. 3, showing a magnetic yoke drive coil.

FIGS. 2 and 3 are isometric views of typical phase shifter sections. A tow-slab 90° microwave phase shifter section of FIG. 2 comprises a single laminated steel core 20 (a spacercore) with one electrical magnet coil 22 for biasing two ferrite slabs 26 and 27 which form a microwave ferrite slab load in a waveguide 28. In the four-slab configuration 30 of FIG. 3, there are two indentical cores 10 and 11, with two coils 32 and 33 on core 10, and two cores 34 and 35 on core 11. The electromagnet assembly biases four ferrite slabs 36, 36', 37 and 37' located in a waveguide 38. A cross-section view of the configuration of FIG. 3 is shown in FIG. 4.

BASIC ATTENUATOR DESCRIPTION

The "High Power Electronic Attenuator" is described in a report RADC-TR-82-90 under Air Force contract F30602-81-C-0057, which is part of the Defense Technical Information Center collection of documents under accession No. AD B065798L. The report is hereby incorporated by reference.

Figure 5:
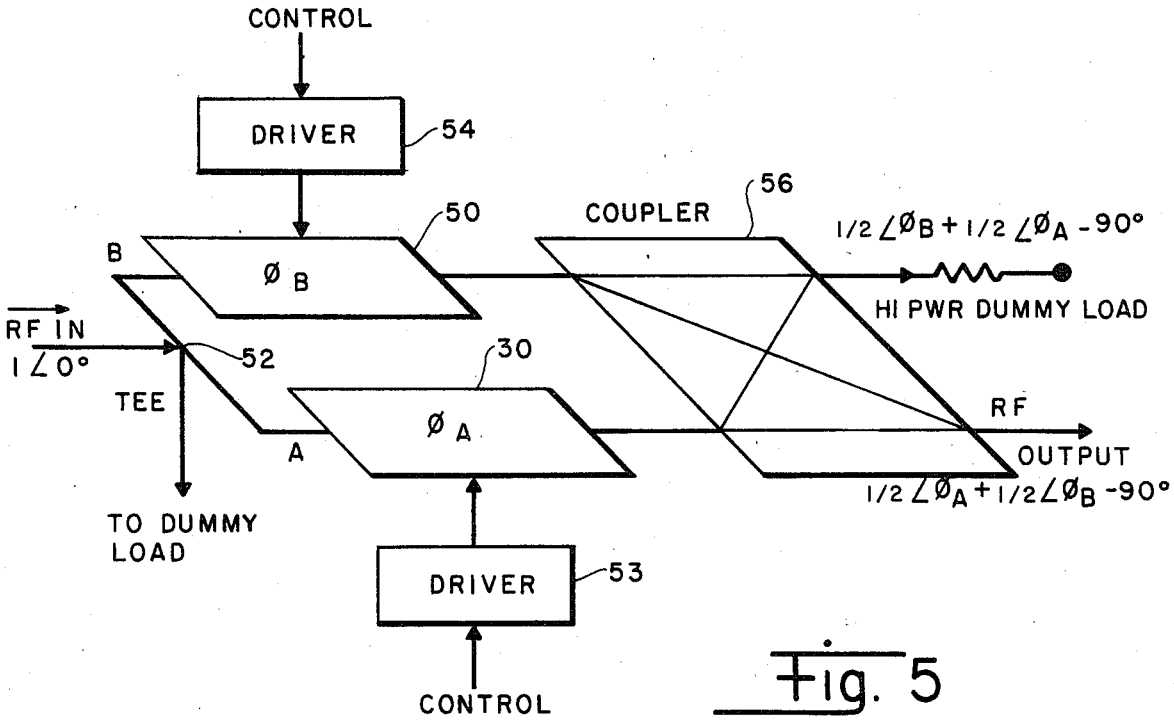
FIG. 5 is a symbolic showing of an attenuator.

The attenuator microwave circuit functions are shown schematically in FIG. 5. The unit consists of a folded hybrid tee 52 which divides the incident RF power in half. The two halves have the same relative phase as well as the same amplitude. Each divided signal then passes through a phase shift section where a relative phase change is introduced. These signals are then recombined in a short slot hybrid coupler 56 before exiting at the RF output of the attenuator.

The phase shift sections must operate from zero to 90° phase shift to achieve minimum to maximum attenuation characteristics. The equation for the theoretical response of the attenuator is derived in FIG. 7 and Table A. Sample theoretical points are superimposed on the actual attenuator response in Table A. See FIG. 8.

Figure 7:
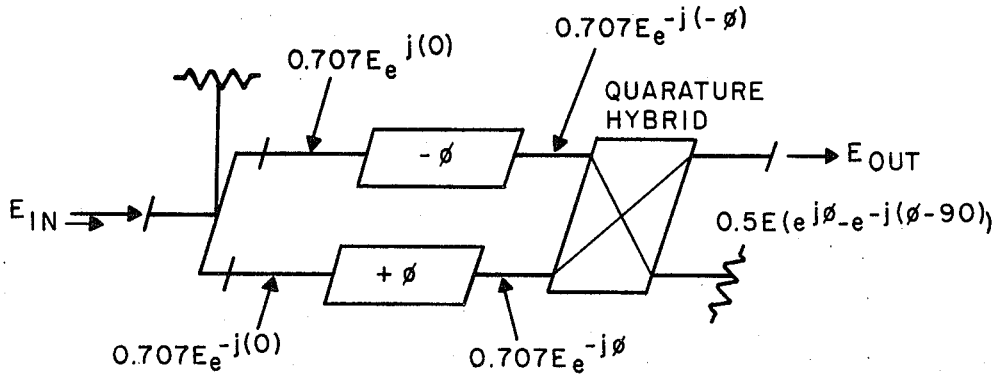
FIG. 7 is a showing like FIG. 5 of an attenuator for explaining the theoretical attenuator response.
Figure 8:
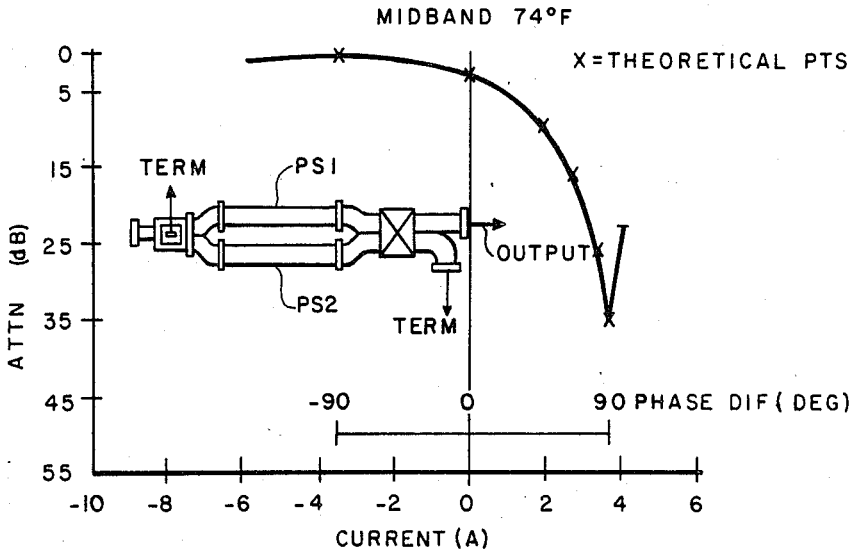
FIG. 8 comprises a graph showing attenuation versus drive current.

TABLE A (See FIG. 7)

$\phi = \theta$ where $\theta$ is differential phase shift

For $-45° \leqq \phi \leqq +45°$ $$\frac{E_{OUT}}{E_{IN}} = 0.5\,[e^{+j\phi} + e^{-j(\phi-90)}] =$$

$$0.5\,[\cos\phi + \cos(\phi - 90) + j(\sin\phi - \sin\phi(\phi - 90)]$$

Substituting $-j\sin(\phi - 90) = j\cos\phi$ $$\frac{E_{OUT}}{E_{IN}} = 0.707\,(\cos\phi + \sin\phi)$$

$$\text{ATTN} = 20\,\text{Log}\,\frac{E_{OUT}}{E_{IN}} = -3\text{dB} + 20\,\text{Log}\,(\cos\phi + \sin\phi)$$

SAMPLE POINTS

| $\theta$[DEG] | $\phi$[DEG] | ATTN [dB] | CURRENT [AMPS] |
|---|---|---|---|
| +90 | +45 | 0 | +3.5 |
| 0 | 0 | −3 | 0 |
| −90 | −45 | −∞ | −3.5 |
| −48 | −24 | −8.9 | −1.8 |
| −72 | −36 | −16.1 | −2.7 |
| −84 | −42 | −25.6 | −3.4 |

Figure 6:
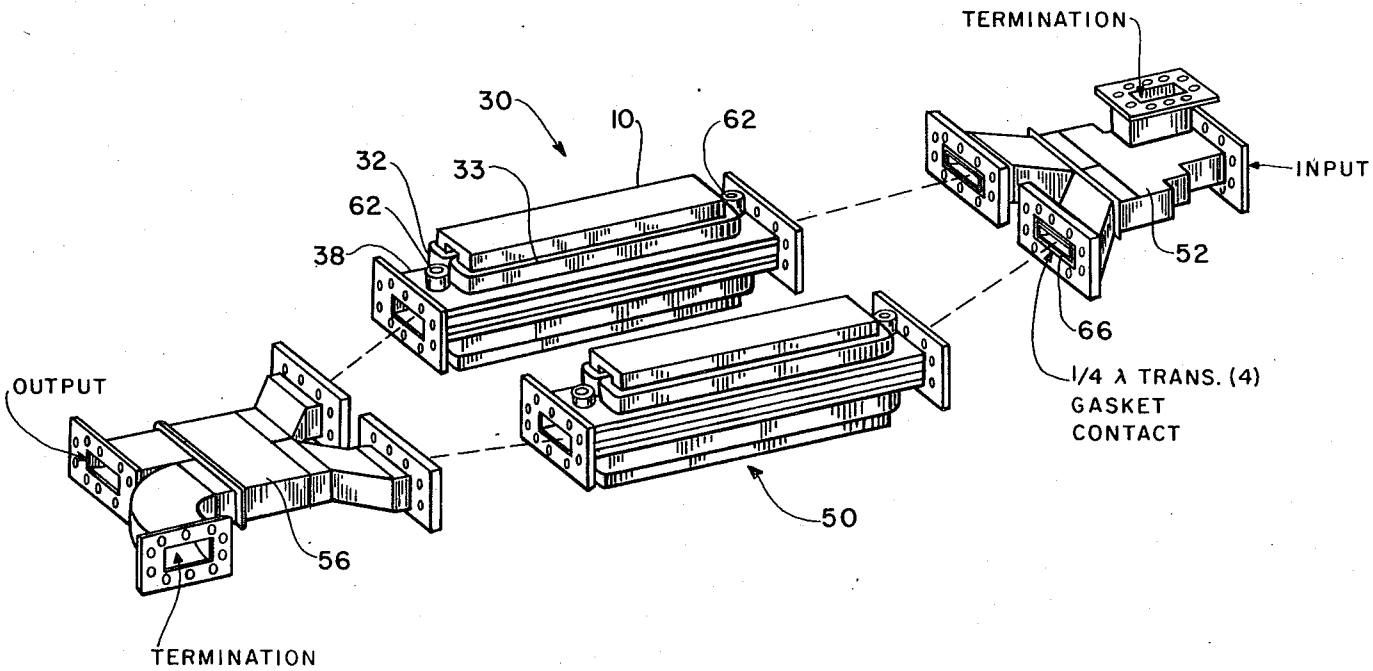
FIG. 6 is an exploded view of a high power variable attenuator.

The 90° phase shifters 30 and 50 consist of a ferrite loaded waveguide section. See FIG. 3. Phase shift is accomplished by controlling an electromagnet that supplies a magnetic field in the direction of the microwave electric field, orthogonal to the ferrite slabs. FIG. 6 shows the mechanical assembly of the composite attenuator. The electromagent yoke assemblies of FIG. 6 constitute 80 percent of the weight of the attenuator. The Spacercore technique described substantially reduces the amount of core material required to supply the magnetic field necessary to operate the attenuator.

The attenuator configuration as shown in FIGS. 4, 5 and 6 consists of a folded H-plane hybrid tee 52 for the input coupler, the two ferrite phase shifters 30 and 50 with integral liquid cooling jackets, and a 3 dB short slot sidewall hybrid 56 for the output coupler.

The signal at the input is divided into equal amplitude, equal phase signals. Each half is passed through a phase shifter. The two signals, whith a controlled differential phase shift between them, are recombined in the sidewall hybrid 56. Either of the output ports may be terminated or used for transmission as required.

Figure 11:
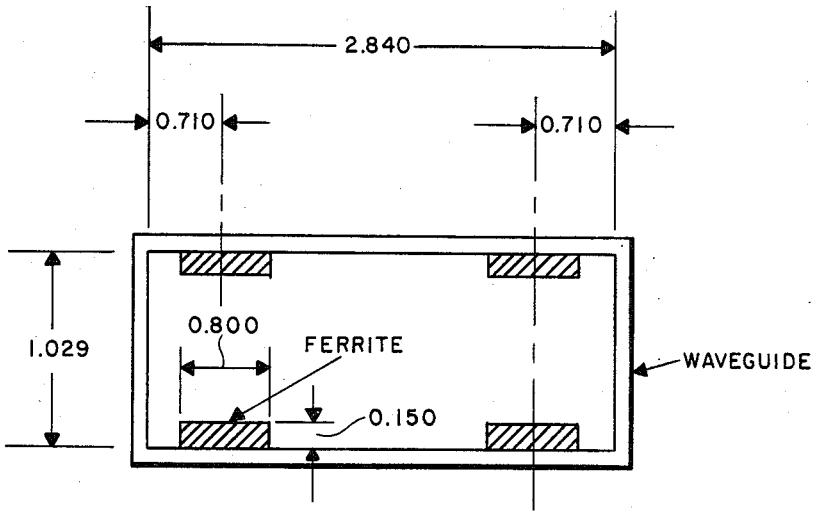
FIGS. 11 and 12 are cross-section and side views respectively of the ferite configuration.
Figure 12:
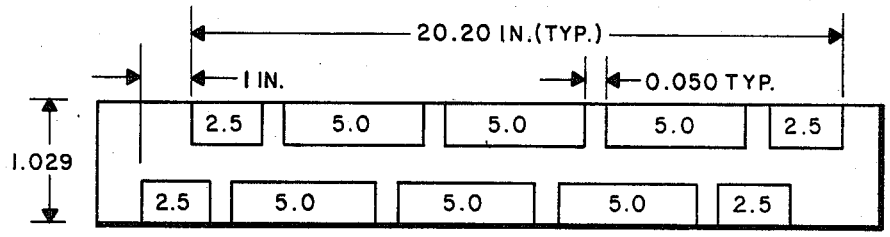

A ferrite configuration was selected as shown in cross ssection in FIG. 11 and a side view in FIG. 12. A gap of 0.050 inch was used between slabs and they were arranged so the gaps of opposite rows would be staggered. This allows thermal expansion without stressing the bond joints under adjacent ferrite slabs and reduces VSWR contrubutions from the air/ferrite gap by staggering individual discontinuities. The total length of ferrite per row is 20 inchess.

The flanges used to couple the input and output hybrids to the phase shifters include four quarter-wave transformers such as 66 and gasket grooves. A 0.007 inch lip, 0.125 inch wide, was used around the waveguide opening. Conductive silicone elastomer gaskets were used. The transformer lenth of 1.170 inches resulted in a VSWR of 1.04/1 maximum over the required bandwidth.

The coolant passages 42 and 44 are shown in the cross-section view of FIG. 4. They are located between the waveguide walls which have the ferrite slabs and the pole faces of the cores 10 and 11. FIG. 6 shows the coolant ports 62 for phase shifter 30 and similar ports for phase shifter 50.

PHASE SHIFT CONFIGURATIONS

The principal difference between the two configurations shown in FIGS. 2 and 3 is that the two-slab configuration of FIG. 2 uses only one C-core magnet, whereas the four-core configuration of FIG. 3 uses two cores to generate the control field. The two-slab configuration will be addressed here, since the magnetic field distribution of the four-slab configuration is more complex. The theory developed, however, is equally applicable to both.

The weight of the two-slab phase shifter is proportional to the core volume. This volume is the product of the cross-sectional area (A) of the ferrite slabs times the length (L) of the slabs times the magnetic path length required to house the magnetic coil. The length of the waveguide section is determined by the charactristics of the ferrite slabs and microwave frequency used.

MAGNETIC CIRCUIT REQUIREMENTS

The high power attenuator developed has a magnetic core length of 22 inches. The maximum flux (B) necessary to drive the phase shifter through 90° is:

$$B = NI\mu/l_e \quad (1)$$

where:

N=Number of Turns

I=Current in Amperes $\mu$=Core Permeability $l_e$=Effective Core Length

The air gap ($l_g$) introduced in the magnetic circuit by the waveguide, makes the magnetic ciucuit appear longer than length ($l_m$) of the C-core. Since the permeability of air is unity, the reluctance of the circuit ($l_m/\mu A$) increases by the air gap length times the permeability of the magnetic core material. To account for the gap, the effective magnetic path length ($l_e$) becomes:

$$l_e = l_m + \mu l_g \quad \mu >> l_m \quad (2)$$

$$l_e = \mu l_g \quad (3)$$

Substituting $\mu l_g$ of equation 3 in place of the $l_e$ in equation 1, the flux density become:

$$B = NI\mu/\mu l_g = NI/l_g \quad (4)$$

Thus, the air gap becomes the controlling factor of flux density.

CORE STRUCTURE

Phase shifters requiring fast switching modes use silicon sheet laminations to reduce the core loss. Earlier models of the high power attenuator used stacked 14 mil laminations for the entire lingth of the 90° phase shifter. The weight of the stacked laminations was 72 pounds for a single 90° section. To reduce this weight, the permeability required to satisfy those conditions ($\mu l_g = 100\ l_m$) stated in equation 3 was calculated. Letting $\mu l_g = 100\ l_m$ $$\mu = 100 l_m / l_g$$

Given a waveguide thickness ($l_g$) of 1.25 inches and the magnetic path ($l_m$) (FIG. 3) of 7 inches, the average permeability required is:

$$\mu_{AV} = 100 l_m / l_g = 100 \times 7/1.25$$

or 560.

This implies that the amount of laminated core material can be reduced by the ratio of the required average permeability to the permeability ($\mu$) of the core material. For silicon steel with a permeability of 3000, this ratio becomes:

$$\mu_{AV}/\mu_{SIL} = 560/3000 = 18.7\%$$

SPACERCORE

The reduction of core material reflects a corresponding weight reduction. To implement the spacercore design, it is necessary to space each lamination with a non-magnetic filler. This provides a uniform field over the entire length (L) of the phase shifter. In the high power attenuator, a 64 mil lightweight transmformer pressboard was used to space each 14-mil silicon steel lamination over the 22 inch core length. (See FIG. 1.) This yielded a core weight reduction of 75 percent.

Figure 9:
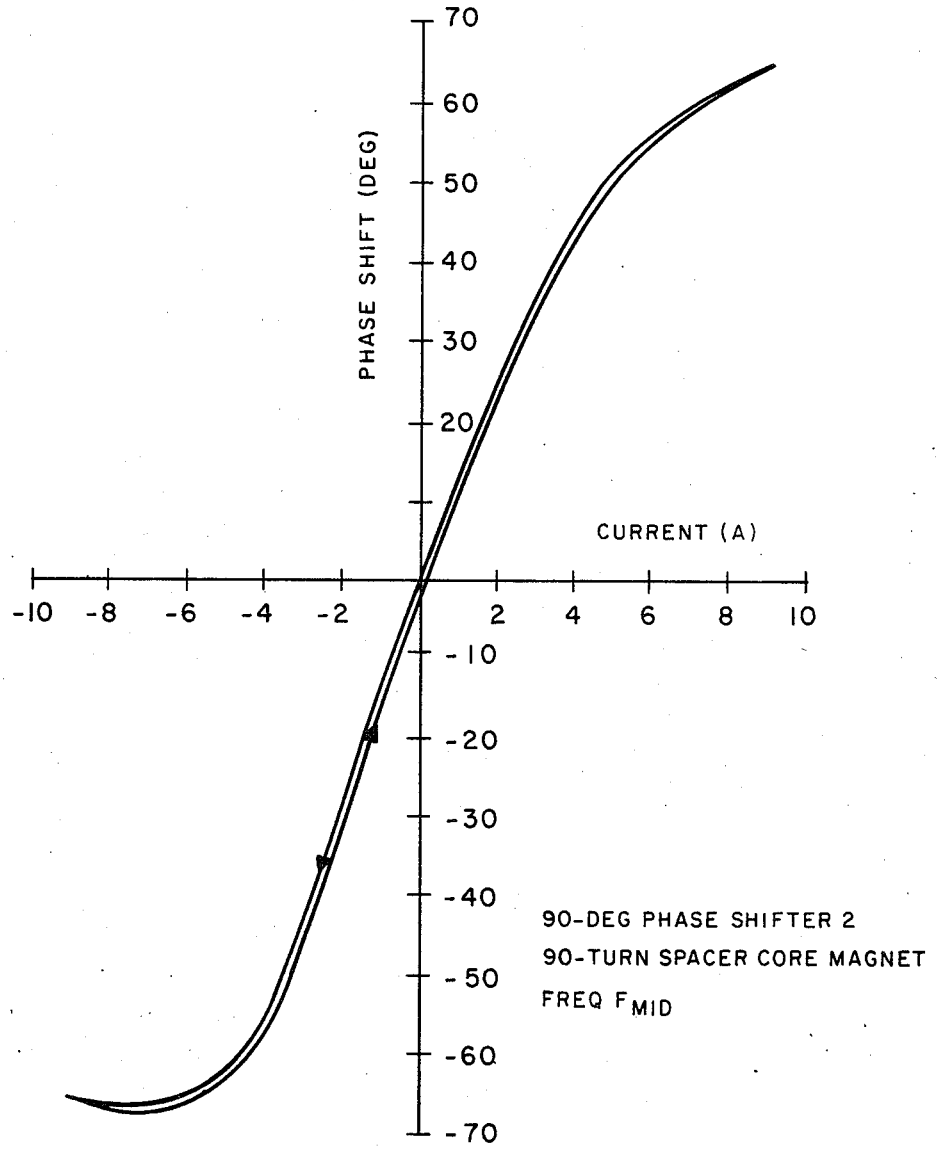
FIGS. 9 and 10 are graphs showing differential phase shift versus drive current.
Figure 10:
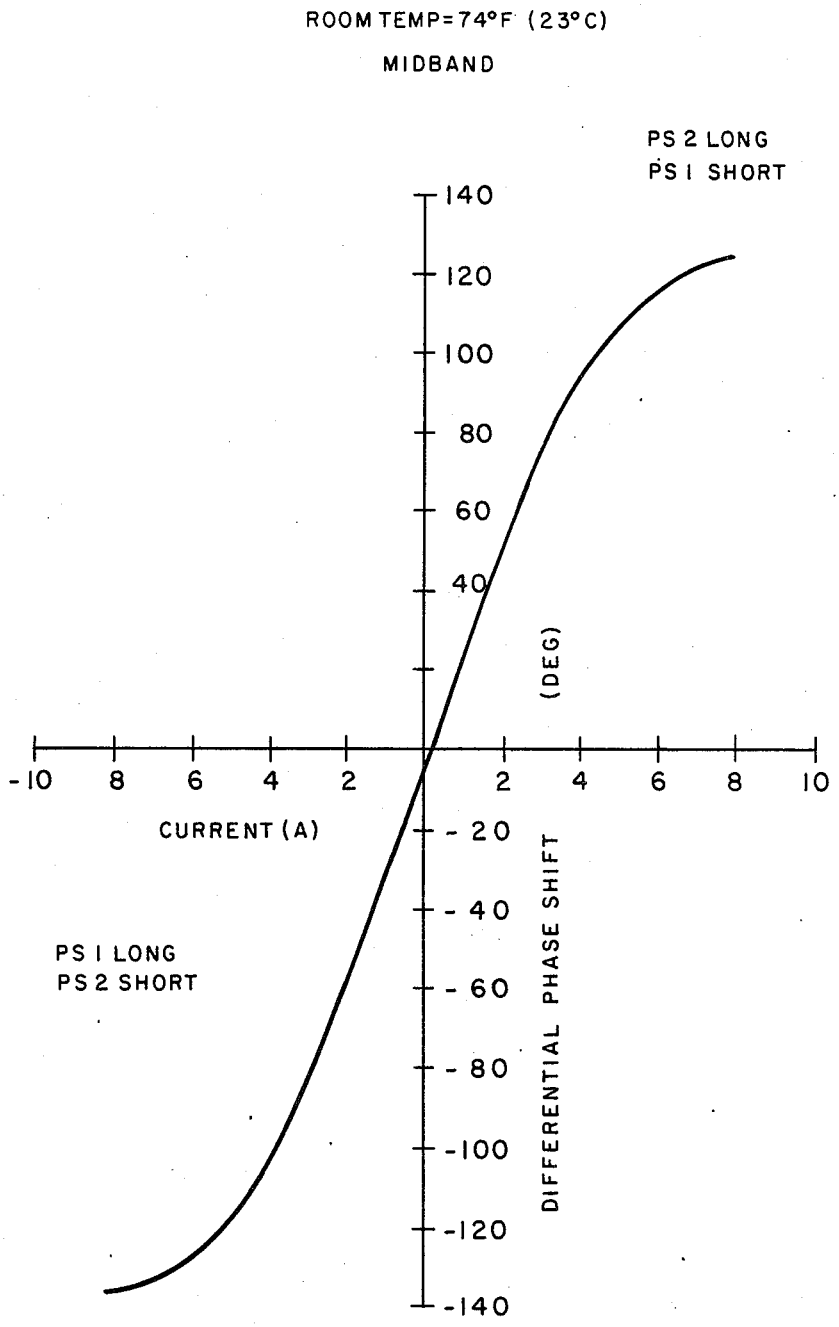

The spacercore construction also reduces the core eddy current and hysterisis losses in proportion to the magnetic material reduction. This is very important when high switching speeds are involved. The technique is not restricted to microwave phase shifters. It may be applied any time the conditions of equation 3 are satisfied. FIGS 9 and 10 compare the results between a steel core magnet and the spacercore magent. The hysterisis is almost totally absent.

Laminated silicon steel spacercore construction is superior to an equivalent ferrite core in that it has a currie temperture in excess of 800° C., whereas the currie temperature of ferrite is limited to 200° C. Because of the higher permeability of the material, the spacercore construction weighs only one-fourth as much as a ferrite core does for the same flux density.

The invention herein therefore provides an improved core structure for a microwave device, such as an attenuator using phase shifters having electromagnets for biasing ferrite slabs located within a waveguide. It is understood that certain structural modifications to the invention as herein described may be made, as might occur to one with skill in the field of this invention, within the scope of the appended claims. Therefore, all embodiments contemplated hereunder which achieve the objects of the present invention have not been shown in complete detail. Other embodiments may be developed without departing from the spirit of this invention or from the scope of the appended claims.

What is claimed is:

1. An electromagnet structure for a high-power variable attenuator using a programmable microwave circulator, wherein the circulator comprises input power divider means which divides input RF power to two phase shifters, and an output hybrid coupler between the two phase shifters and an output RF port to recombine the power, the power form the input power divider means to the two phase shifters having the same relative phase and the same amplitude, the two phase shifters being controlled to introduce a relative phase shift, the two phase shifters being designed to operate from zero to 90° phase shift to achieve minimum to maximum attenuation characteristics;

wherein each of said phase shifters comprises a waveguide section having ferrite slabs mounted on interior walls, and the electromagnet structure forms a yoke for each phase shifter, comprising core means for each phase shifer with winding means on part of the core means, the core means having pole faces adjacent opposite outer surfaces of the waveguide means, so that there is an air gap between the pole faces, the ferrite slabs being located in the air gap to be biased by the magnetic flux;

wherein the core means includes laminations of magnetic material having a high permeability, with a magnetic path having a first portion through the magnetic material and a second portion through the air gap, so that the effective length of the magnetic path is equal to the sum of first and second terms, the first term being the length of the first portion and the second term being equal to said permeability multiplied by the length of the second portion, the second term being very large such that the first term is insignificant and therefore the flux density is substantially equal to ampere turns supplied by said winding means divided by the length of the air gap, and the permeability required is much smaller than the permeability of the magnetic material;

wherein said core means further includes a non-magnetic filler forming spacers between said laminations, the laminations being relatively thin and the spacers comparatively thick so that the resulting average permeability is sufficient to provide said required phase shift.

2. a structure according to claim 1, used with a waveguide in which cross-sections have four of said ferrite slabs, two on one surface and two on the opposite surface, and the core means for each phase shifter comprises two U-shaped sections, one having two pole faces adjacent the two slabs of the one surface and the other having two pole faces adjacent the two slabs of the opposite surface, whereby the air gap has two equal portions, and the winding means comprises four coils for each phase shifter, two on each section of the core means on parallel portions thereof, with each section of the core means having said laminations of magnetic material and said non-magnetic spacers.

3. A structure according to claim 2, wherein said magnetic material is silicon steel having a permeability on the of 3000, and said non-magnetic filler is lightweight transformer pressboard.

4. An electromagnet structure for supplying magnetic flux to bias an element of a high-power microwave device wherein the electromagnet structure forms a yoke for said element, comprising core means, with winding means on part of the core means, the core means having pole faces with a gap between them, said element being located in the gap;

wherein the core means includes laminations of magnetic material having a high permeability, with a magnetic path having a first portion through the magnetic material and a second portion through the gap, so that the effective length of the magnetic path is equal to the sum of first and second terms, the first term being the length of the first portion and the second term being equal to said permeability multiplied by the length of the second portion, the second term being very large such that the first term is insignificant and therefore the flux density is substantially equal to ampere turns supplied by said winding means divided by the length of the gap, and the permeability required is much smaller than the permeability of the magnetic material;

wherein said core means further includes a non-magnetic filler forming spacers between said laminations, the laminations being relatively thin and the spacers comparatively thick so that the resulting average permeability is sufficient to provide a maximum value of flux for providing a specified operation of the device.

* * * * *